US005274315A

United States Patent [19]

Finocchi

[11] Patent Number: 5,274,315

[45] Date of Patent: Dec. 28, 1993

[54] CARD WEB COMB DRIVING SYSTEM IN MACHINES FOR THE TEXTILE INDUSTRY

[75] Inventor: Paolo Finocchi, Prato, Italy

[73] Assignee: Montenero O.M.T.P. Officina Meccanica di Finocchi Paolo & C. SNC, Florence, Italy

[21] Appl. No.: 899,983

[22] Filed: Jun. 17, 1992

[30] Foreign Application Priority Data

Jun. 18, 1991 [IT] Italy ..... FI/91/A/000150

[51] Int. Cl.[5] ..... D01G 19/26; H02K 41/06

[52] U.S. Cl. ..... 318/686; 318/127; 19/225

[58] Field of Search ..... 318/119, 138, 254, 439, 318/126, 127, 129, 671, 686; 19/220, 225

[56] References Cited

U.S. PATENT DOCUMENTS

| | | | |
|---|---|---|---|
| 3,749,991 | 7/1973 | Kuniyoshi | 318/254 |
| 4,329,636 | 5/1982 | Uchida et al. | 318/721 |
| 4,678,974 | 7/1987 | Guastadini | 318/254 |
| 4,730,150 | 3/1988 | Lee et al. | 318/225 |
| 5,022,122 | 6/1991 | Clement | 19/225 |

FOREIGN PATENT DOCUMENTS

| | | |
|---|---|---|
| 1685604 | 7/1971 | Fed. Rep. of Germany . |
| 1351572 | 12/1963 | France . |
| 1203414 | 8/1970 | United Kingdom . |

*Primary Examiner*—Bentsu Ro
*Attorney, Agent, or Firm*—Browdy and Neimark

[57] ABSTRACT

A card web comb driving system in machines for the textile industry comprising a comb structure (27) mounted in such a way as to oscillate around a resting position under the control of elastic means (23 and 24) which accumulate mechanical energy and are associated with electrical motor means (20) of the type in which the direction of rotation can be inverted with the variation of the electrical signal. The motor means (20) is associated with a sensor (31) of the instantaneous angular position of the shaft (30) of the motor (20) and consequently of the instantaneous angular position of the comb structure (23, 26 and 27). The sensor (31) is connected to the power supply (21) of the motor (20) in order to establish a persistent oscillatory condition on the movable element of the motor (22) and consequently on the comb structure. The motor (20) can be represented by a brushless type motor or by a direct current motor with a constant excitation field. The invention provides the advantage of allowing the utilization of a structure of elastic motor truly tailored to the work that must be carried out by the card web comb and of permitting a more precise adjustement of the operating parameters of the card web comb in order to adapt the motion to various work situations.

15 Claims, 3 Drawing Sheets

CARD WEB COMB DRIVING SYSTEM IN MACHINES FOR THE TEXTILE INDUSTRY

DESCRIPTION

1. Field of the Invention

The present invention relates to a card web comb driving system for the textile industry.

2. Background Art

Card web combs are devices used in the textile industry at the end of the carding cycle and are in fact utilized for the detachment of the web of oriented fibers which are found on the last cylinder of the carding machine.

The detachment of the web of fibers is accomplished by means of the angular oscillation of a comb member in an alternative way in an angular direction at a relatively high frequency, on the order of 40–50 Hz, the comb being provided with a blade which skims the teeth or hooks placed in the periphery of the carding cylinder.

Two well-known techniques for driving the web comb exist in the machines in question. The first technique is of a mechanical type in which the comb is driven by an articulated quadrilateral comprising an eccentric connected to a motor, for the purpose of obtaining the desired law of motion for the web comb. This requires a relatively complex mechanical structure with numerous parts in reciprocating motion, which limits the maximum operating frequency obtainable.

The second technique is illustrated in French patent No. 1351572 filed 28 Dec. 1962 and issued 30 Dec. 1963 in the name of A. Thibeau & Cie.. This technique utilizes a single phase induction motor without auxiliary field, that is without self-start capability, the rotor of which is associated with a mechanical member, in this case a torsion bar, which accumulates elastic energy.

Taking advantage of the fact that a single-phase induction motor without auxiliary field can rotate indifferently in a clock-wise or counter-clock-wise direction once a starting torque is applied to it, and suitably designing the elastic constant of the torsion bar, the moment of inertia of the rotor as well as the structures rigidly connected to it and the stall torque of the rotor, a situation occurs in which the rotor cycles in either a clock-wise or counter-clock-wise direction, with the amplitude and frequency of the oscillation being determined by the moment of inertia, the elastic constant of the torsion bar and the value of the stall torque of the motor.

The object of the present invention is to provide an electromechanical construction which permits the avoidance of the above-described inconveniences of the known techniques.

SUMMARY OF THE INVENTION

According to the present invention a card web comb driving system is provided which comprises a oscillating mechanical arrangement having a mechanical energy accumulator member such as a torsion bar, and means for activating and maintaining the oscillation of the system comprising a machine for generating a driving torque, the sign of which can be inverted by electric means, associated with an angular position sensor or angular velocity sensor connected to said electric means of inversion of the sign of the driving torque, the arrangement being such that the frequency of oscillation of the system is based solely on the mechanical parameters of the oscillation system, and the supply of driving torque by the electric machine to the system is independent from the instantaneous angular velocity of the system for the entire range of the oscillation.

Furthermore according to the present invention, said electric machine for generating a driving torque preferably comprises a brushless type motor, and said position or angular velocity sensor is constituted by an electromagnetic sensing device able to drive electric switching means for inverting the sign of the driving torque delivered from said brushless motor for the purpose of establishing a condition of persistent mechanical oscillation at a frequency determined solely by the mechanical parameters of the oscillatory system.

DESCRIPTION OF THE DRAWINGS

The present invention will now be described with reference to one of its possible embodiments presently preferred and based on the attached drawings in which.

BEST MODE OF CARRYING OUT THE INVENTION

Figure 1:
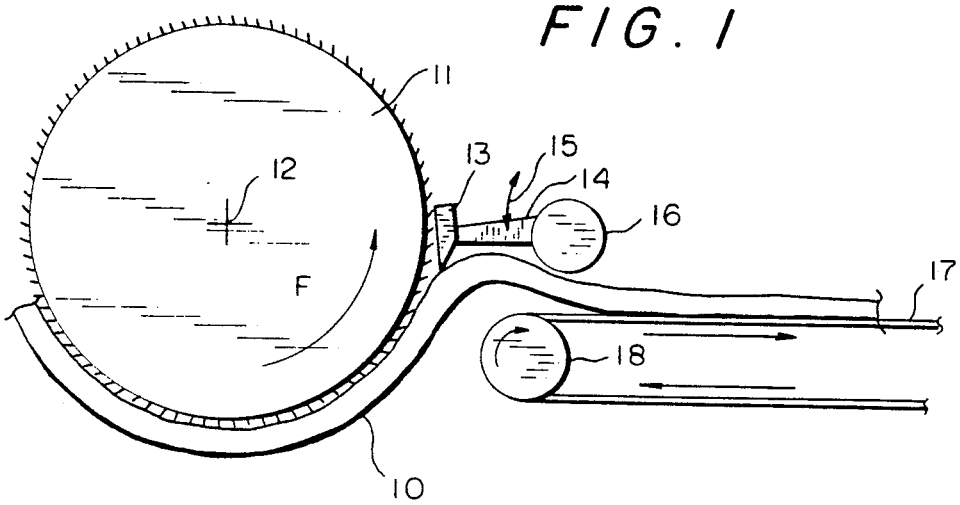
FIG. 1 shows the general structure of a card web comb to which the present invention is applicable.

With reference to FIG. 1, an arrangement is shown for a card web comb of a machine for the textile industry to which the present invention is applicable. The card web 10 is drawn from a carding cylinder 11 rotating on an axis 12 in the direction of the arrow F. On the periphery of the cylinder 11 combs indicated in 13 operate, carried by a reciprocating arm 14 as indicated by the arrows 15, and are mounted on an angularly oscillating shaft indicated at 16. The card web 10 detached from the periphery of the cylinder 11 is laid down on a conveying belt 17 which travels on rollers 18 in a known way.

Figure 2:
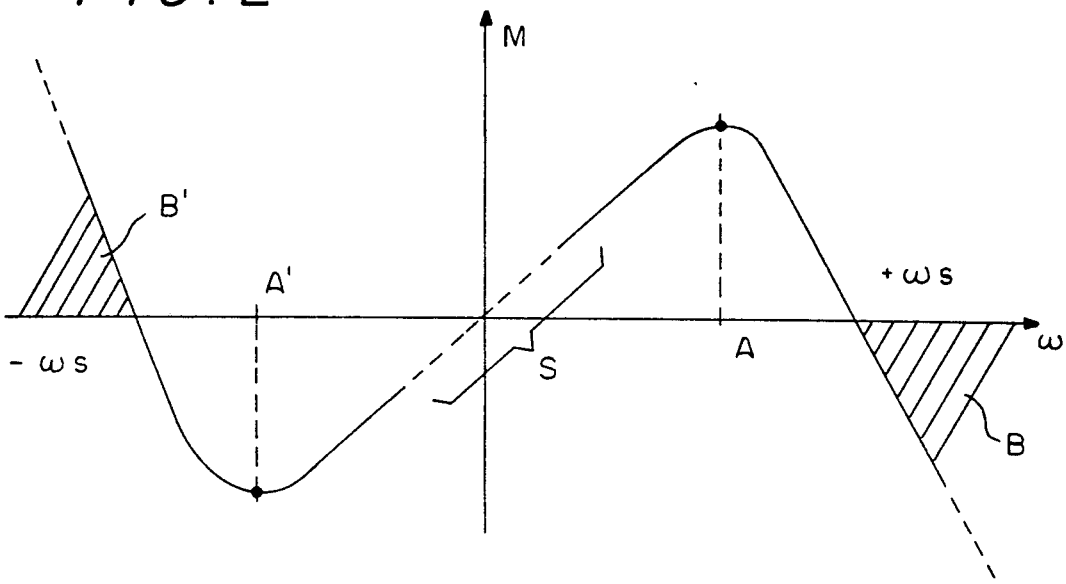
FIG. 2 shows the relation between driving torque and angular velocity for an electric single-phase induction motor, fed under constant frequency power and without starting fields.

A known arrangement from the previously identified French patent, for the driving of the comb assembly 13 supported by the shaft 16, provides for the use of a single-phase induction motor supplied under constant frequency power, and without starting fields, associated with a returning elastic element for accumulating mechanical energy which begins oscillating due to the peculiar characteristics of an electric motor of this type. The characteristics of an electric motor of this type are illustrated schematically in FIG. 2. In FIG. 2, there is shown a cartesian diagram of the driving torque provided by the motor versus the angular velocity of the rotor of the motor. It can be noted that for an angular velocity of zero, the torque provided is zero. If the rotor undergoes a "starting" action, corresponding to the dashed portion around the origin of the abscissa, the motor will pick up speed rotating in a clock-wise or counter-clock-wise direction depending on sign of the starting torque, until arriving at the delivery of a maximum torque in correspondence with points A, Al, until reaching a point $+\omega S, -\omega S$, in which the torque provided by the motor becomes zero if the angular velocity of the rotor corresponds to the angular synchronism speed. As previously illustrated, the synchronism speed is that for which the rotational speed of the armature corresponds to the rotational speed of the rotating field of the motor. For angular velocities of higher absolute value than $\omega S$, corresponding to the hatched areas B,B1, the electric motor, instead of delivering driving torque, absorbs it providing the electric network with power. In the arrangement described in the above cited French patent, the rotor of the induction motor oscillates between areas B,B1 under the restoring torque of an elastic energy accumulator member such as a torsion bar. Arrangement of this type presents various inconveniences. First, at the time of application of electric energy with all parts at rest, that is with a stand still electric motor rotor, it stays stalled with a very high power drain since an electric motor in such conditions is comparable to a transformer with its secondary winding in short circuit. Furthermore, as can be seen from the pattern of the driving torque M as a function of the rotation velocity $\omega$ of the motor, the driving torque delivered is not constant but shows large variations and, in correspondence with the end points of the cycles, the rotor stops before inverting its direction of rotation, again with strong power drain since the rotor is stalled. This causes an undue consumption of electric power, an appreciable heating of the motor caused by the strong currents passing through it, and consequently the necessity of an over-sizing of the motor itself with respect to the mechanical power which must be actually delivered to the card web combs.

Consequently, even if the arrangement illustrated and described in the French patent indicated above is, from a certain point of view, clever in that it eliminates complex and wear-subjected mechanisms, it can't be considered convenient from an energetic point of view.

Figure 3:
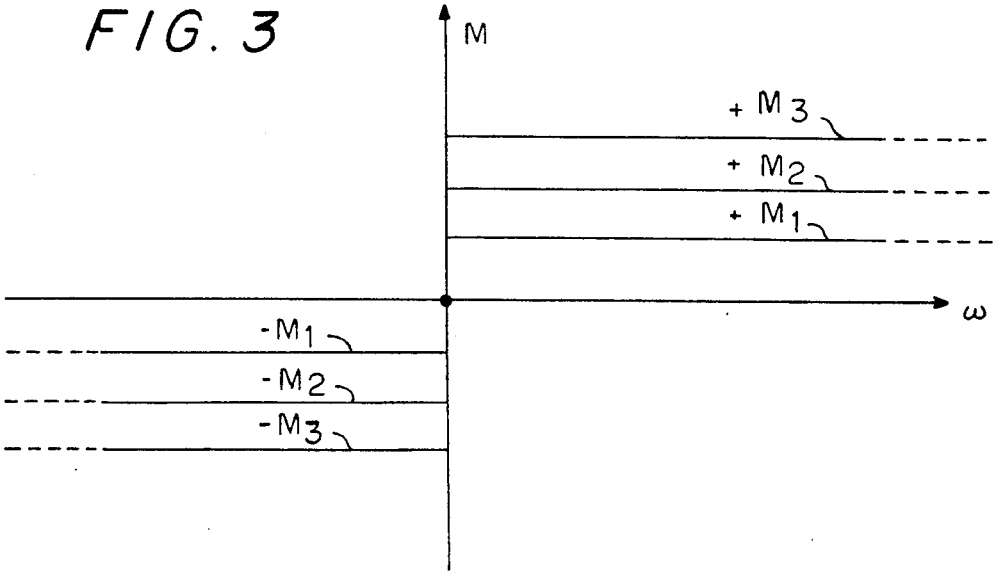
FIG. 3 shows the relation between deflecting torque and angular velocity for a brushless type motor, or for a D.C. motor with a constant rotor field, having a constant current power supply.

As previously described, the present invention provides for the use of a brushless type motor or a direct current motor with constant field magnetic flux, fed with constant current, for instance by means of a chopper technique well-known to experts in the field. With a motor of this type, the characteristics of driving torque as a function of the angular velocity are of the type illustrated in FIG. 3. As can be seen the driving torque M is constant as a function of the angular velocity $\omega$ of rotation of the motor and is represented by families of straight lines +M1, +M2, +M3 and −M1, −M2, −M3. The positive and negative output torques correspond to the inversion of polarity of the power supply of the motor, which can be obtained in a brushless type motor by inverting the connections of the field coils in a well-known way, or rather by inverting the polarity of the power supply of the rotor in the case of a commutator-type D.C. motor.

An expert in the field will note immediately that critical angular velocities do not exist for which there are undue absorptions of electric power without "holes" of driving torque, since in an arrangement of this type critical angular velocities do not exist for the mobile part of the motor. In fact, the brushless type or commutation-type D.C. motors behave like a torque generator, the sign of which can be inverted in the above described way.

Furthermore, since the power supply is of the constant current type, with a variation in the nominal operating current, different values of the driving torque delivered by the motor in each direction of rotation may be obtained, thus making it possible, as will be seen, the variation in amplitude of the oscillations of the card web comb indicated by the arrows 15 in FIG. 1.

Figure 4:
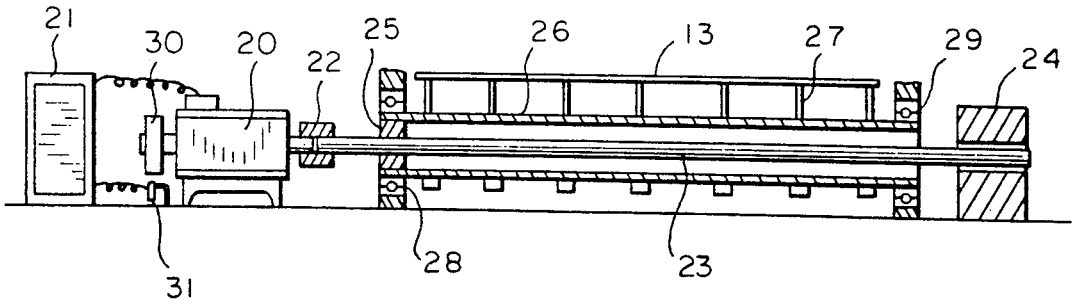
FIG. 4 shows schematically the motor arrangement for a card web comb according to the present invention.

In FIG. 4 the electromechanical arrangement of the drive system according to the present invention is illustrated. As can be seen in FIG. 4, a brushless type motor 20 is provided for, supplied under constant current by means of a power supply 21, preferably of a chopper type well known to an expert in the field. The rotor of the electric motor 20 is coupled through a joint 22 to a torsion spring 23 fastened at one end to a reaction block 24. The torsion spring 23 is coupled in 25 with a hollow shaft 26 carrying the card web combs 27. The hollow shaft 26 is pivotally mounted on ball bearings 28, 29 in a known way.

The shaft of the motor 20 cooperates with a position or angular speed sensor comprising a mobile part 30 integral with the motor shaft and a stationary part 31. The assembly 30, 31 can be embodied in numerous different ways. The structure of the sensor 30 can be, for example, constituted of a Hall effect magnetic sensor or a variable reluctance sensor, a rotating differential transformer or the like. Sensors of this type are well known in the field and a detailed description of them is not deemed necessary. The important quality of the assembly 30, 31 is that it provides a signal proportional to the angle of rotation or the speed of rotation of the rotor of the motor 20 and therefore of the free end of the torsion spring 23 and of the card web combs 27, in order to provide a signal for starting the oscillation of the system. The element 30 or the element 31 can be angularly displaced with respect to one another to provide an output signal which will be applied to the power supply 21 with the appropriate phase for assuring the start of angular oscillations of the card web comb. In fact, if a position sensor is used, its signal must be differentiated because the sign of the supply voltage of the motor is a function of the direction of motion, and therefore of the velocity, and not of the position. This, among other things eliminates the problem of angular phasing of the sensor, since during differentiation the constant represented by the phase disappears.

Figure 5:
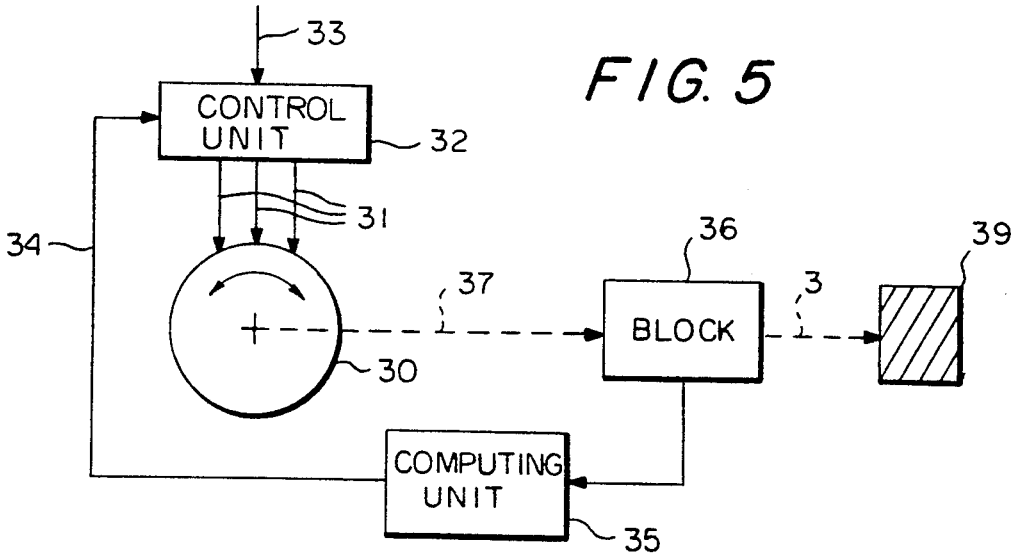
FIG. 5 shows an electrical block diagram of the arrangement of FIG. 4.

In FIG. 5, there is illustrated the electric and functional block diagram of the arrangement according to the present invention. As can be seen in FIG. 5, a motor 30, for example of a brushless type, or a commutator-type D.C. motor with constant field flux excitation, is supplied through the power lines 31 with a control unit 32 for driving and for inverting the direction of rotation. The control unit 32 is supplied at 33 by a source of electric power (not shown), and receives on a line 34 a control signal of the switch of inversion of the rotational direction of the motor 30 processed by a computing unit 35 for the signal coming from the block 36 corresponding to the elements 30, 31 of FIG. 4. The block 35 for processing the signal coming from the unit 36 can comprise for example phase delay or phase advance circuits (differentiators with respect to time or integrators) as is well known to an expert in automatic controls. The mechanical output of the motor 30 indicated by the broken line 37, obviously passes on the group 36, and continues in 3 towards the user 39 which is the composite structure comprising the card web comb and the torsion spring.

Figure 6:
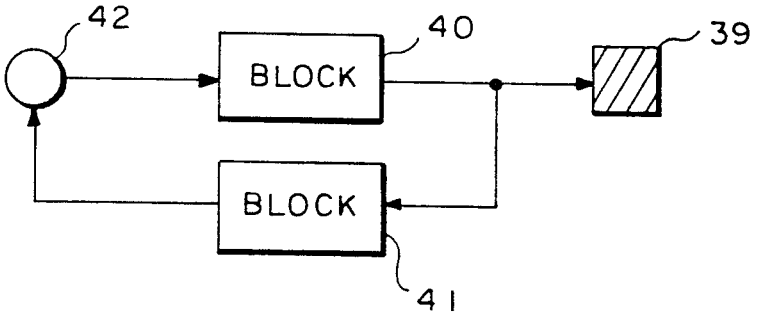
FIG. 6 and 7 and show schematic examples to illustrate the operation shown in FIGS. 4 and 5.
Figure 7:
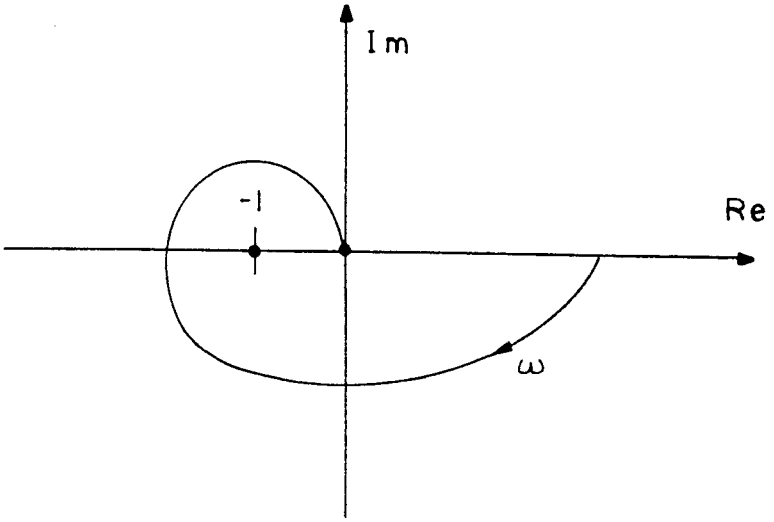

FIGS. 6 and 7 indicate the functional criteria of the equipment illustrated in FIG. 5. Referring to the techniques of automatic controls, there is a block 40 which indicates the power supply of the electric motor and circuitry for the inversion of its direction of rotation. The output of the block 40 goes towards the block 39 previously described, and towards block 41 which comprises the elements 35 and 36 previously described to provide a signal which in 42 is brought to the control inputs of the unit 40. This is the classic scheme of a feedback system, which will be designed not to provide stability, as in the conventional automatic controls, but to provide a condition of oscillation. From a mathematical point of view, this is illustrated in FIG. 7 in which the coordinates of the real and immaginary parts of the transfer function of the system are represented according to the well-known Nyquist diagram. The descriptive function, with the variation of instantaneous angular velocity of the motor 30, must include the classic point "−1" in order to establish a situation of persistent oscillation for the entire mobile equipment of the system.

In a modification of the present invention, the control unit 32 of the motor 30 could comprise means for limiting the amplitude of the oscillations which operates by acting on the constant current power supply of the motor 30 (see families of curves illustrated in FIG. 3), and auxiliary means for engaging and disengaging the card web comb from the carding cylinder. These auxiliary means are not described in detail since their structure and design criteria are well-known to experts in the field.

From the above, it can be noted that the arrangement according to the present invention has numerous advantages with respect to the known techniques which are exemplified in the former French patent previously described, since it allows for the utilization of a structure of electric motor truly tailored to the work which must be performed by the card web combs, and furthermore it allows for a more precise adjustment of the operating parameters of the card web combs since the range of persistant oscillations can be easily adjusted with electric means to adapt it to various work situations.

The present invention has been described in reference to one of its possible and currently preferred embodiments, but it shall be understood that in practice variations and modifications can be brought to it without departing from the scope of the invention itself.

What is claimed is:

1. A card web comb drive system in machines for the textile industry, said system comprising:

a comb structure mounted to freely and symmetrically oscillate around a resting position, said comb structure engaged to and controlled by elastic means for accumulating mechanical energy, said comb structure engaged to electric motor means for actuating said comb structure, said electric motor means associated with invertor means for inverting a direction of movement of said electric motor means due to a variation of an inputted electric signal, a sensor associated with said electric motor means which measures in instantaneous velocity of a rotating element of said electric motor means and consequently an angular position or an instantaneous angular velocity of said comb structure, wherein an electric signal inputted from said sensor, coupled with a power supply unit supplying constant power to said electric motor means, initiates a condition of persistent oscillation of said rotating element of said electric motor means and consequently said comb structure.

2. A system according to claim 1, wherein said electric motor means is a brushless type motor.

3. A system according to claim 1, wherein said electric motor means is a Dc motor with a constant excitation field.

4. A system according to claim 1, wherein said electric motor means is a variable reluctance motor.

5. A system according to claim 1, wherein said electric motor means is a linear motor.

6. A system according to claim 1, wherein that said electric motor means is fed in direct current under "constant current".

7. A system according to claim 6, wherein said sensor is a Hall-effect type angular position sensor.

8. A system according to claim 6, wherein said sensor is an inductive sensor.

9. A system according to claim 6, wherein said sensor is a rotary differential transformer type sensor.

10. A system according to claim 6, wherein said sensor is of a tachometric generator type.

11. A system according to claim 6, wherein said sensor is constituted of a resolver.

12. A system according to the claim 1, wherein the chain formed by the power supply unit the sensor, the elastic means, and the comb structure constitute an oscillating system with persistent oscillations.

13. A system according to claim 12, wherein the torque provided by said electric motor means in initial drive conditions has a value different from zero.

14. A system according to the claim 1, wherein the power supply unit for said electric motor means is arranged for providing variable electric energy to said motor for the purpose of varying the amplitude of the persistent oscillations in the system.

15. A system according to the claim 6, wherein said constant direct current is realized by means of a chopper system.

* * * * *